US006722393B1

(12) United States Patent
Marett et al.

(10) Patent No.: US 6,722,393 B1
(45) Date of Patent: Apr. 20, 2004

(54) ON LOOM DRYER

(75) Inventors: Larry A. Marett, Cheraw, SC (US); Joe Nicholson, Burkes Garden, VA (US)

(73) Assignee: Highland Industries, Inc., Greensboro, NC (US)

( * ) Notice: Subject to any disclaimer, the term of this patent is extended or adjusted under 35 U.S.C. 154(b) by 150 days.

(21) Appl. No.: 10/153,563

(22) Filed: May 22, 2002

(51) Int. Cl.[7] ..... D03D 41/00
(52) U.S. Cl. ..... 139/291 R
(58) Field of Search ..... 139/291 R, 1 R, 139/304; 26/81, 92, 6; 34/273, 274

(56) References Cited

U.S. PATENT DOCUMENTS 3,629,953 A * 12/1971 Fleming ..... 34/646
3,861,062 A 1/1975 Wymann ..... 34/160
3,961,651 A * 6/1976 Balentine, Jr. ..... 139/291 R
4,194,540 A 3/1980 Reynolds ..... 139/291
5,477,890 A * 12/1995 Krummheuer et al. .. 139/291 R
6,155,306 A * 12/2000 Katsukura et al. ..... 139/11

OTHER PUBLICATIONS

Information on Radiant Heater Raymax 1010; undated.

* cited by examiner

*Primary Examiner*—Danny Worrell
(74) *Attorney, Agent, or Firm*—MacCord Mason PLLC

(57) ABSTRACT

A water jet loom having an on loom drying system. The water jet loom includes: a frame; a warp former; a shed former; a weft inserter and a two mode on loom dryer system downstream from the weft inserter. In the preferred embodiment, the two mode on loom dryer includes: a high volume air supply downstream from the weft inserter; and a second dryer adjacent to the high volume air supply. Also, in the preferred embodiment, the second dryer being at least one of radiant or convection heaters; and a fabric web take-up means.

38 Claims, 5 Drawing Sheets

ON LOOM DRYER

BACKGROUND OF THE INVENTION (1) Field of the Invention

The present invention relates generally to water jet looms and, more particularly, to an on loom dryer system for a water jet loom.

(2) Description of the Prior Art

Fabric made on a water jet loom is wet on the machine. It typically has somewhere between about 12%–14% moisture when it gets rolled up. Normal moisture regain for nylon is about 4%–5% if it's just been produced and is sitting there dry. One problem with the fabric being wet is that you have to dry the fabric to prevent it from mildewing. If it sits over about 5–6 days, the fabric will start to mildew because there are usually no mildew preventive measures in the water. Thus, presently the normal process is to run it through the finishing unit just to dry it. However, this additional step adds about 20 cents a yard to the cost of producing the fabric.

One approach has been to keep the wet fabric in refrigerator trailers. However, in the summertime, because the amount of heat the fabric sees on the trailers, the cost can be up to $1500 a month, per trailer. If all of the production of a plant was done that way, the cost would be prohibitive. In addition, the amount of fabric that is in the process may be excessive because it must be finished within a certain period of time to keep it from mildewing.

Thus, if the fabric was already dried, it could be shipped directly to processing and get through the system a lot faster. Also, every time you can eliminate a fabric-handling step you improve the quality and reduce the cost because the drying process on the finishing unit actually creates defects in the fabric that wouldn't be there if the process way was eliminated.

Still another problem is that if you don't dry on the loom and just take the fabric up in the normal wet state, creases can be created because at a loom stop, particularly a long one, there is some inherent drying in the room. Specifically, the fabric sitting in the room does dry slightly and when there is some drying there is an accompanying dimensional change in the web. That slight dimensional change can result in creases as the fabric travels over rollers. If there is a part of the fabric that's necked in and a part that hasn't necked in, then at that transition the fabric will usually get a crease. Since in subsequent processing the fabric goes through many rolls and accumulators, the likelihood of a crease accruing is quite high.

Many different kinds of heaters have been tried to dry the fabric on the loom including radiant heaters. Also, different ways of moving the heater away from the fabric when the loom stops, by flipping it back or flipping it up to prevent overheating the fabric have been tried. However, when different types of direct heat or radiant heat were used, it was found that it was impossible to get the heat away from the fabric fast enough when the looms stopped. This causes the fabric to pucker in that section where the heat was concentrated for an extended period of time.

Also, trying to evaporate down from like between about 12%–16% down to 4% in a very short space with just infrared heat requires quite a bit of infrared heat. The energy is quite high and the problem of unexpected loom stops and removing that heat source very quickly becomes more acute. In addition, another problem is that as you apply heat to the web, the heat transfer is much different at the edges of the fabric than in the center of the web. With just infrared heat, you actually have to put in more heat at the edges than at the center to account for the heat transfer. This arrangement makes the heater process quite complicated. Because of these problems, earlier direct heating efforts have failed.

Some on loom assisted air drying has been tried before such as disclosed in U.S. Pat. No. 4,194,540, issued to Reynolds, which is hereby incorporated by reference in its entirety. The loom taught by Reynolds brings in some air underneath the roller. There is a little regenerative blower on the loom from the vacuum motor that's rejecting hot air for the back end slot on the loom by putting air into each end of a trough. However, the volume of air is not sufficient to effectively remove enough moisture to dry the fabric nor does hot air alone have sufficient heat capacity to dry the fabric on loom. Air drying has been used off loom on a continuous air dryer. However, these dryers are similar to finishing ranges and are just as expensive to operate. So there may be no real cost saved.

Thus, even if the fabric went directly to a continuous dryer or finishing machine, since all looms have unexpected stops, the fabric is going to be more expensive and the fabric is still going to have creases. Alternatively, if you try to use any direct heating methods on the loom there are problems with adequate drying and with fabric pucker.

Thus, there remains a need for a new and improved water jet loom having an on loom dryer system which produces fully dried fabric at a significantly reduced cost while at the same time prevents both puckering and creasing.

SUMMARY OF THE INVENTION

The present invention is directed to a water jet loom having an on loom drying system. The water jet loom includes: a frame; a warp forming means; a shed fonning means; a weft inserting means; and a two mode on loom dryer system downstream from the weft inserting means. In the preferred embodiment, the two mode on loom dryer includes: a high volume air supply downstream from the weft inserting means; and a second dryer adjacent to the high volume air supply. Also, in the preferred embodiment, the second dryer will be at least one of radiant or convection heating; and a fabric web take-up means.

In the preferred embodiment, the fabric web take-up includes a frame; a plurality of rollers; and a drive means. The fabric take-up may further include a walk board and a fabric compensator. Also, in the preferred embodiment, the weft inserting means includes a jet nozzle and a jet pump.

In the preferred embodiment, the high volume air supply includes a high volume air blower impinging air onto the surface of the web; the second dryer is a radiant heater adjacent to the high volume air supply; and further includes a control system for selectively activating the radiant heater. In the most preferred embodiment, the high volume air blower is a tangential blower.

The high volume air blower preferably produces greater than about 1000 CFM per linear yard with about 2500 CFM being preferred. The high volume air blower produces air perpendicular to the fabric web.

In the preferred embodiment, the radiant heater is a radiant emitter panel that produces about 10 watts per square inch. The radiant heater is preferably spaced from the fabric surface to produce a fabric surface temperature greater than about 100° F. and most preferably about 120° F.

In the preferred embodiment, the radiant heater is downstream of the high volume air supply. In the most preferred embodiment, the radiant heater is opposed to the high volume air supply.

The control system may include at least one stop motion detector for determining when to deactivate the radiant heater. The apparatus may also further include a heat shield movable between the radiant heater and the fabric surface.

There is an eight second delay in starting the blower after the loom starts so the blower does not try to start when "jogging" the loom.

Accordingly, one aspect of the present invention is to provide a water jet loom having an on loom drying system, the water jet loom comprising: a frame; a warp forming means; a shed forming means; a weft inserting means; and a high volume air dryer system downstream from the weft inserting means.

Another aspect of the present invention is to provide a two mode on loom dryer system for a water jet loom having a frame; a warp forming means; a shed forming means; and a weft inserting means, the dryer comprising: a high volume air supply downstream from the weft inserting means; and a second dryer adjacent to the high volume air supply, the second dryer being at least one of radiant or convection heating.

Still another aspect of the present invention is to provide a water jet loom having an on loom drying system, the water jet loom comprising: a frame; a warp forming means; a shed forming means; a weft inserting means; a two mode on loom dryer system downstream from the weft inserting means including: (i) a high volume air supply downstream from the weft inserting means; and (ii) a second dryer adjacent to the high volume air supply, the second dryer being at least one of radiant or convection heating; and a fabric web take-up means.

These and other aspects of the present invention will become apparent to those skilled in the art after a reading of the following description of the preferred embodiment when considered with the drawings.

DESCRIPTION OF THE PREFERRED EMBODIMENTS

Figure 1:
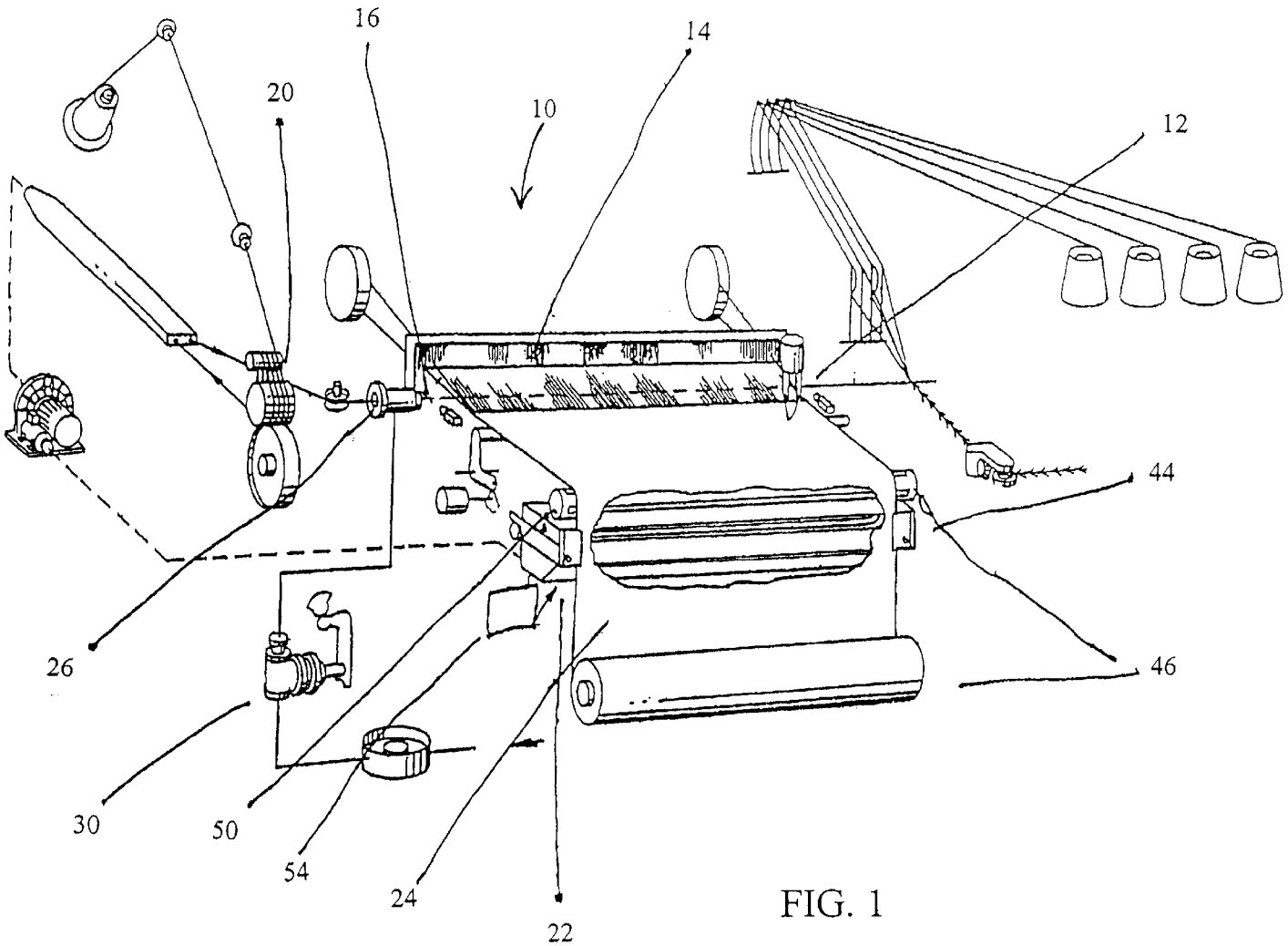
FIG. 1 is a schematic drawing of a water jet loom illustrating an on loom drying system constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a water jet loom, generally designated 10, is shown constructed according to the present invention. The water jet loom 10, is comprised of a frame 12, warp forming means 14, shed forming means 16, weft inserting means 20 and a high volume dryer system 22. In the preferred embodiment, the water jet loom 10 further includes a fabric web take up means 24.

Figure 2:
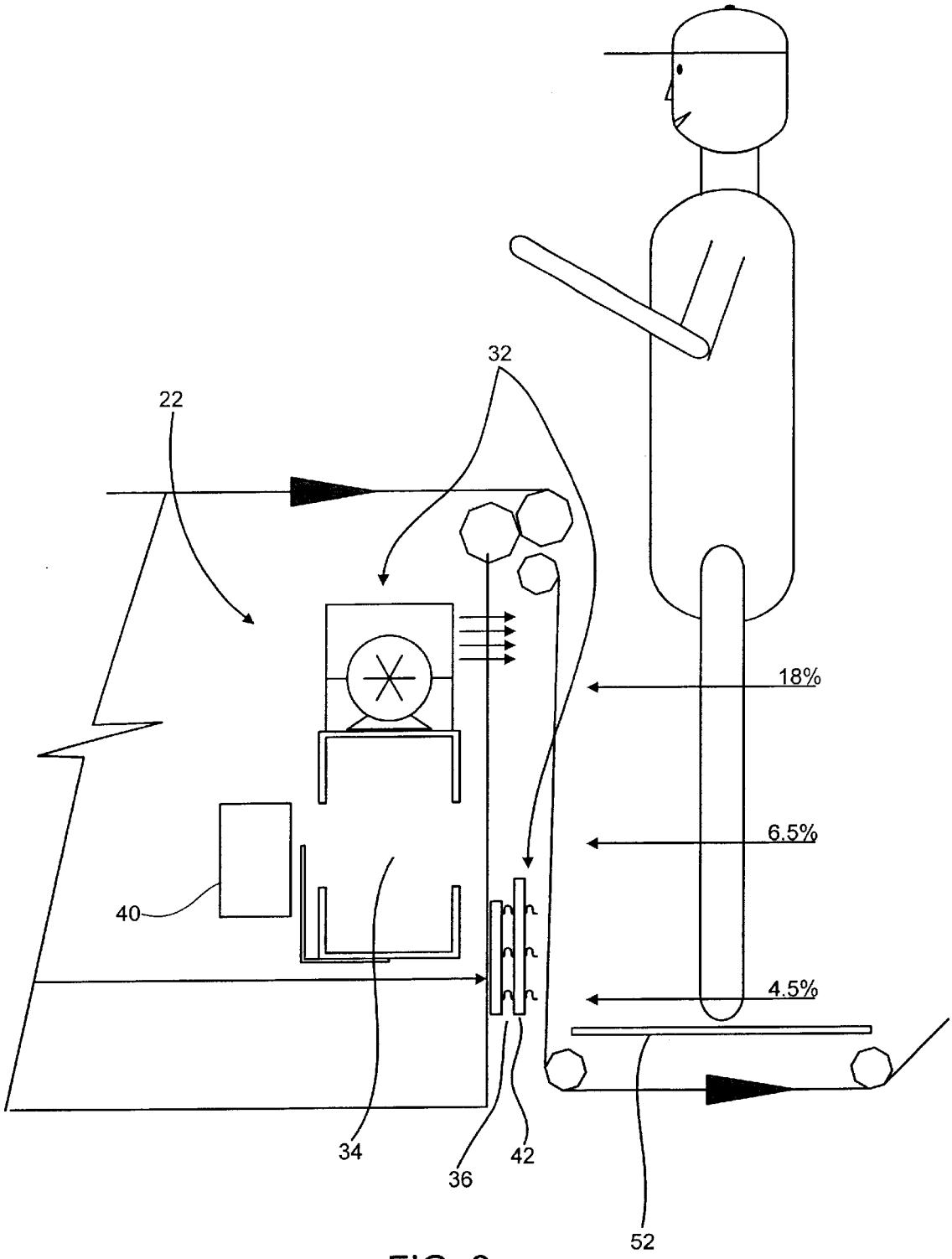
FIG. 2 is a schematic drawing of the high volume dryer system.

The weft inserting means 20 includes a jet nozzle 26 and a jet water pump 30. The fabric take up 24 comprises a frame 44, rollers 46 and a drive means 50. Fabric web take up 24 further includes a walk board 52 as seen in FIG. 2 and a fabric compensator 54, as seen in FIG. 1. Selected yarns are affixed to the warp forming means 16 and are advanced further into the weaving process. The jet pump 30 of the inserting means 20 forces water and yarn through jet nozzle 26 to complete the fabric in the weaving process.

After the fabric has been formed by the weaving process in the water jet loom 10 the fabric passes to the high volume dryer system 22, which is downstream from the weft inserting means 20. The high volume dryer system 22 can best be seen in FIG. 2.

In the preferred embodiment, the blower is greater that about 1000 CFM with about 2500 CFM being preferred. The blower may be up to about 6000 CFM. One such blower, which is particularly suitable, is a Model SE 3434-2 available from Continental Fan Manufacturing, Inc. at 203 Eggert Road in Buffalo, N.Y.

In addition to the blower, the loom uses the inherent drying capability of the plant air conditioning system to suppress the dew point in that room. The capability of that air to remove moisture out of the fabrics is like drying clothes outside.

The fabric contains approximately 18 percent moisture after the weaving process is completed. The wet fabric passes by the high volume air blower 34, as shown in FIG. 2, which is blown directly onto the surface of the fabric. This process in the preferred embodiment reduces the moisture from approximately 18 percent to 6.5 percent.

In the preferred embodiment, the dryer system 22 is composed of a two mode drying process 32 with at least one of the drying modes being radiant heat in addition to the high volume blower. The fabric continues to travel through the radiant heater 36, which is adjacent to the high volume air blower 34 as seen in FIG. 2. In the preferred embodiment, the heater provides sufficient heating to heat the surface of the fabric web to about 120° F. One such heater, which is particularly suitable, is a RAYMAX®, Model 1010, available from Star Electric, Inc. at 9360 Industrial Trace in Alpharetta, Ga.

In the preferred embodiment, a conventional programmable controller 40 regulates and selectively provides the radiant heat. One such controller, which is particularly suitable, is a Watlow, Inc., Model 93, available from Star Electric, Inc. at 9360 Industrial Trace in Alpharetta, Ga. Also in the preferred embodiment, a removable heat shield 42 is attached between the fabric surface and the heater and selectively movable between the fabric surface and the radiant heater 36.

Once the fabric passes through the radiant heater 36, reduction in moisture is from 6.5 percent to approximately 4.5 percent. This two-step process reduces sufficient moisture from the fabric so that no further drying is required and the step of taking the fabric to the drying room, which is necessary with traditional water jet systems can be totally eliminated.

It is believed that blown room temperature air reduces fabric moisture to such a point that when the on loom dryer applies the radiant heat to further the process, the system does not have to apply as much heat and there is a lot less wet in the web. This eliminates the big variables on the puckering and the creases because much easier to remove with that small amount of moisture on the fabric with a "dumb" heater. Basically, the heat input is so small that it does not damage the fabric but it is still sufficient to dry the remaining moisture.

Figure 3:
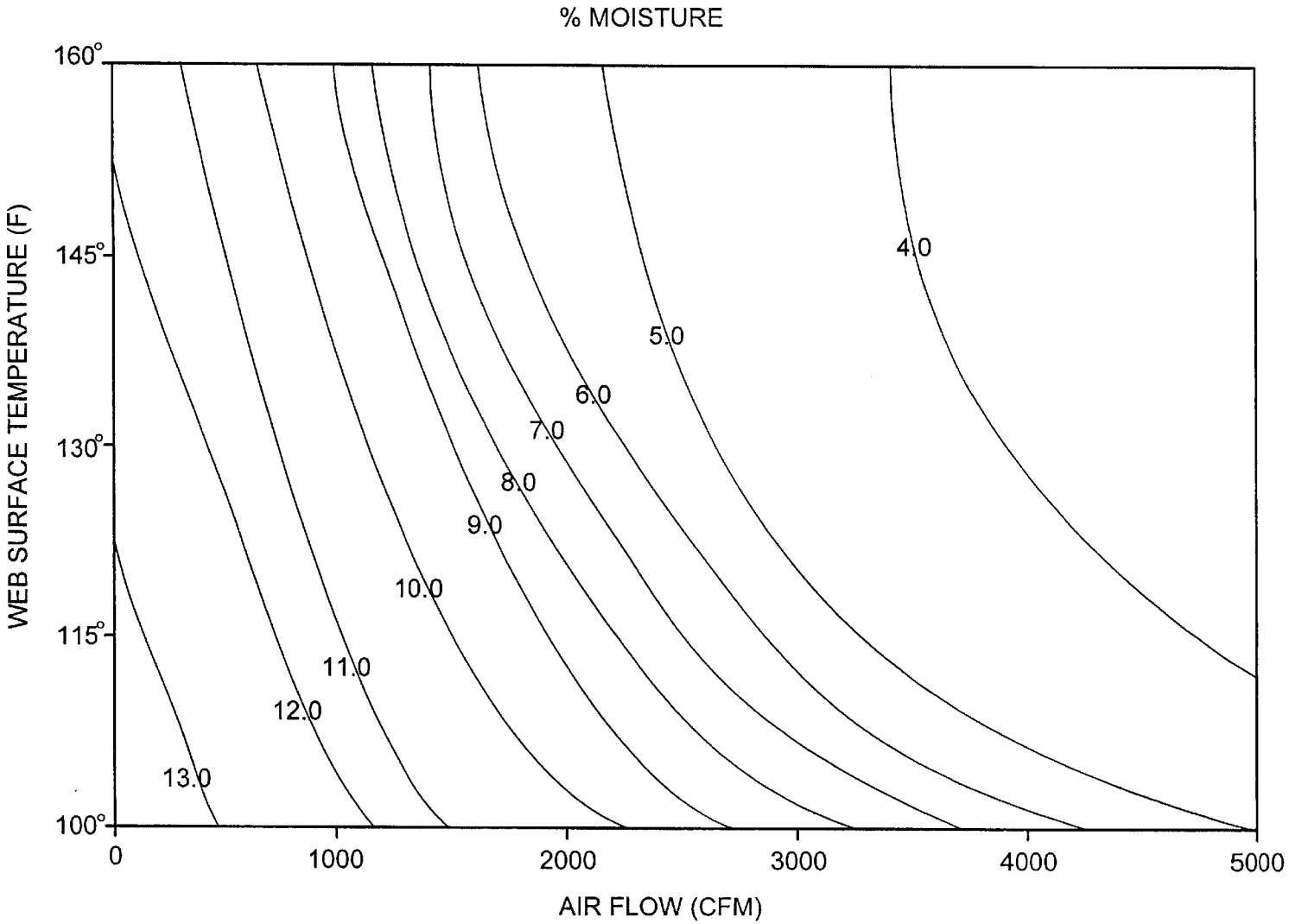
FIG. 3 is a graphical representation of the percent moisture of the fabric web as a function of air flow (CFM) and web surface temperature (° F.)

As best seen in FIG. 3, there is shown a graphical representation of the percent moisture of the fabric web as a function of air flow (CFM) and web surface temperature (° F.). As can be seen, the combination of the high volume air blower and a small but sufficient amount of radiant heat removes the moisture from the fabric permitting immediate shipment or use in other post drying fabric procedures without damaging the fabric as would occur with high direct heating of the fabric web.

Figure 4:
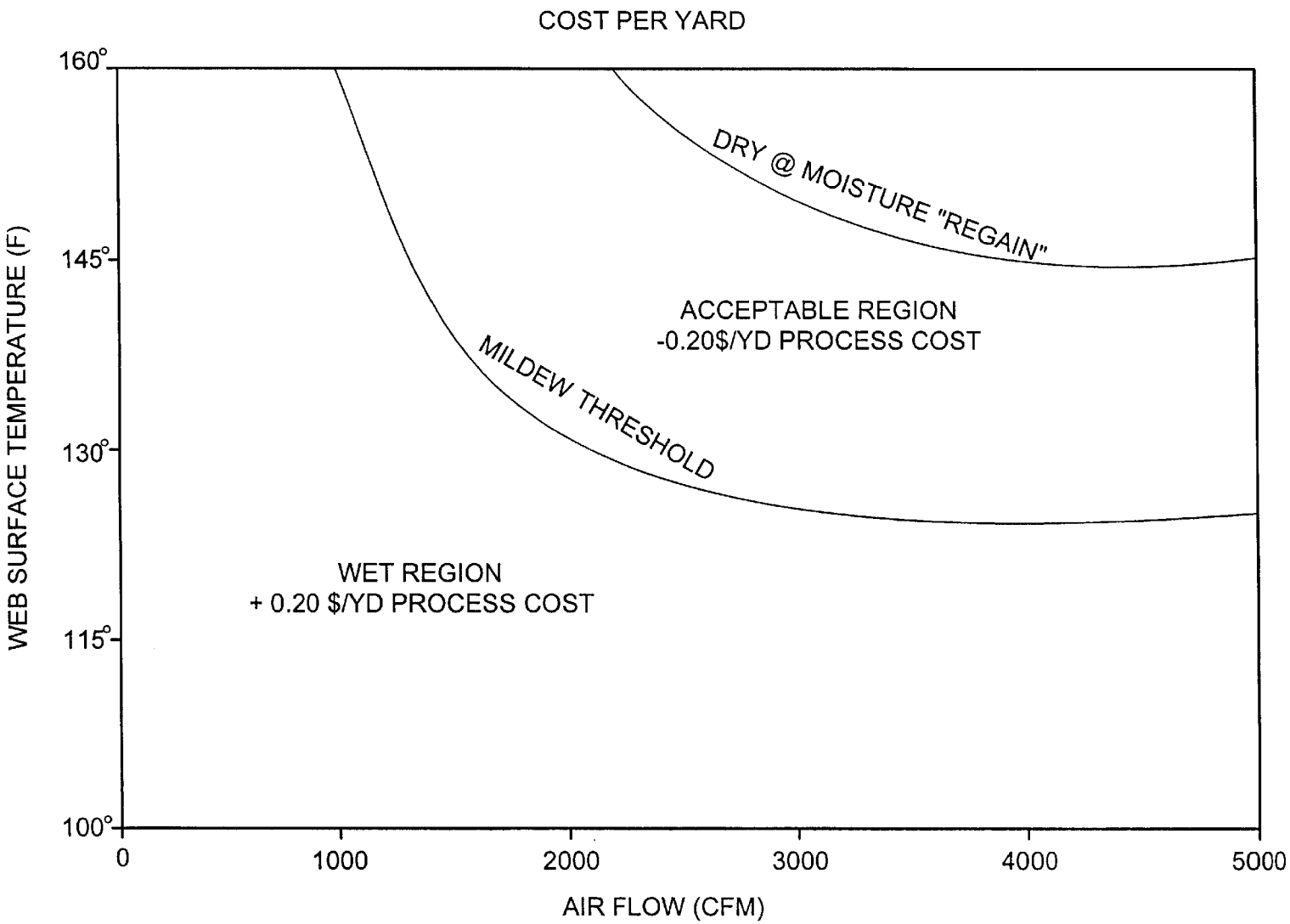
FIG. 4 is a graphical representation of the cost per yd. of the fabric web as a function of air flow (CFM) and web surface temperature (° F.)

Also, as best seen in FIG. 4, there is shown a graphical representation of the cost per yd. of the fabric web as a function of air flow (CFM) and web surface temperature (° F.). As can be seen, the combination of the high volume air blower and a small but sufficient amount of radiant heat removes moisture at much lower cost than would occur with high direct heating of the fabric web.

Figure 5:
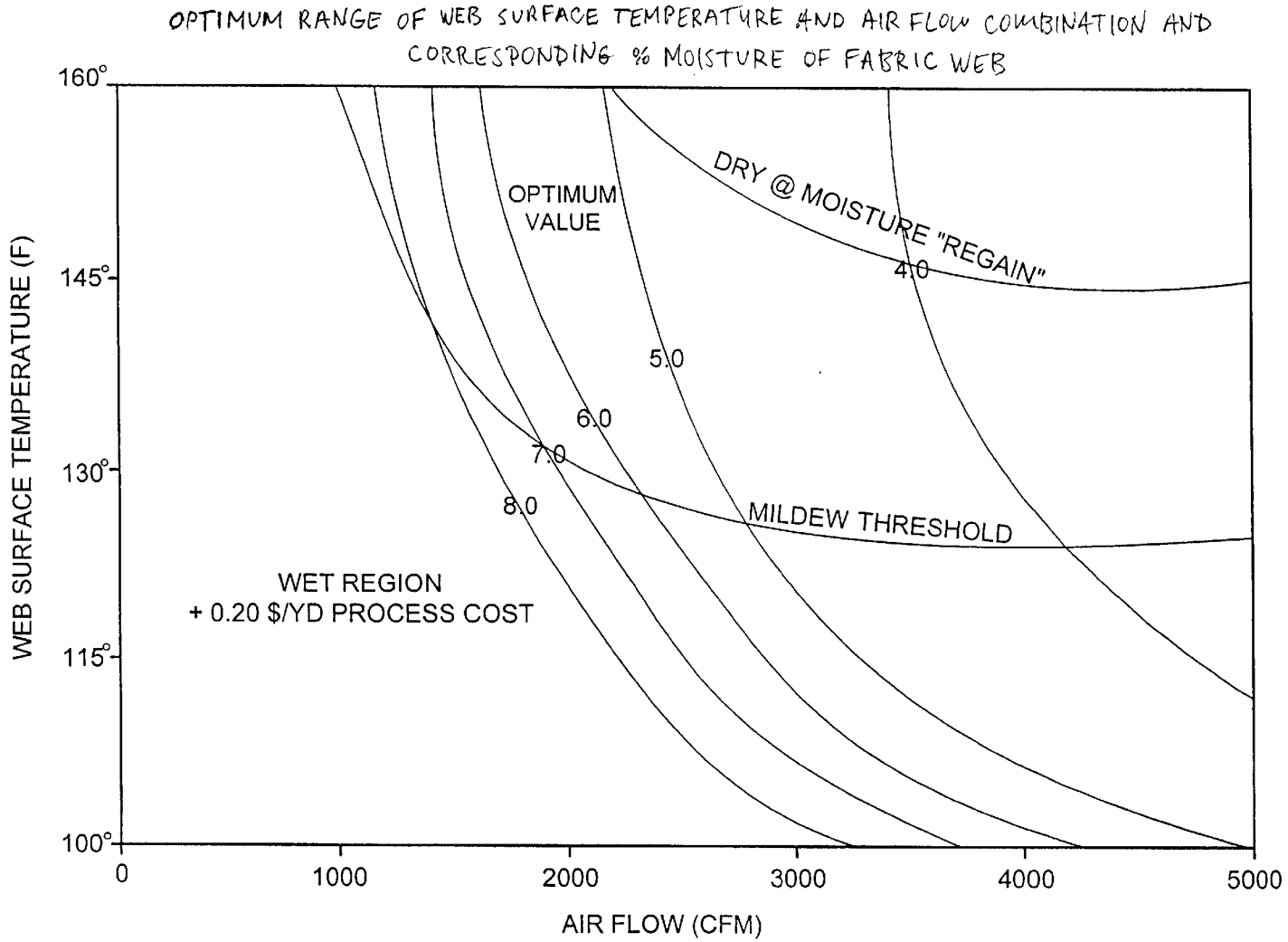
FIG. 5 is a graphical representation of the optimum range of the web surface temperature (° F.) and air flow (CFM) combination and corresponding percent moisture of the fabric web.

Finally, FIG. 5 is a graphical representation of the optimum range of the web surface temperature (° F.) and air flow (CFM) combination and corresponding percent moisture of the fabric web.

Certain modifications and improvements will occur to those skilled in the art upon a reading of the foregoing description. By way of example, heated air could be directed to the web from a combination blower/heater unit. Also, ducting could be used to direct heated or unheated air to multiple looms from a central, large blower or blower/heater unit. In addition, the extra waste heat from the vacuum motor could be directed through a roller, such as taught by Reynolds. It should be understood that all such modifications and improvements have been deleted herein for the sake of conciseness and readability but are properly within the scope of the following claims.

We claim:

1. A water jet loom having an on loom drying system, said water jet loom comprising:

(a) a frame;

(b) a warp forming means;

(c) a shed forming means;

(d) a weft inserting means; and (e) a high volume air dryer system downstream from said weft inserting means.

2. The apparatus according to claim 1, further including a fabric web take-up means.

3. The apparatus according to claim 2, wherein said fabric web take-up includes a frame; a plurality of rollers and a drive means.

4. The apparatus according to claim 2, where in said fabric take up further includes a walk board.

5. The apparatus according to claim 2, wherein said fabric web take-up further includes a fabric compensator.

6. The apparatus according to claim 1, wherein said weft inserting means includes a jet nozzle and a jet pump.

7. A two mode on loom dryer system for a water jet loom having a frame; a warp forming means; a shed forming means; and a weft inserting means, said dryer comprising:

(a) a high volume air supply downstream from said weft inserting means; and (b) a second dryer adjacent to said high volume air supply, said second dryer being at least one of radiant or convection heating.

8. The apparatus according to claim 7, wherein said high volume air supply includes a high volume air blower impinging air onto the surface of the web; said second dryer is a radiant heater adjacent to said high volume air supply; and further including a control system for selectively activating said radiant heater.

9. The apparatus according to claim 8, wherein said high volume air blower is a tangential blower.

10. The apparatus according to claim 8, wherein said high volume air blower produces greater than about 1000 CFM per linear yard.

11. The apparatus according to claim 10, wherein said CFM per linear yard is about 2500 CFM.

12. The apparatus according to claim 8, wherein said high volume air blower produces air perpendicular to the fabric web.

13. The apparatus claimed in claim 8, wherein said radiant heater is a radiant emitter panel.

14. The apparatus according to claim 13, wherein said radiant emitter panel produces about 10 watts per square inch.

15. The apparatus according to claim 8, wherein said radiant heater produces a fabric surface temperature greater than about 100° F.

16. The apparatus according to claim 15, wherein said radiant heater produces a fabric surface temperature of about 120° F.

17. The apparatus according to claim 8, wherein said radiant heater is downstream of said high volume air supply.

18. The apparatus according to claim 8, wherein said radiant heater is opposed to said high volume air supply.

19. The apparatus according to claim 8, wherein said control system includes at least one stop motion detector for determining when to deactivate said radiant heater.

20. The apparatus according to claim 19, further including a heat shield movable between said radiant heater and the fabric surface.

21. A water jet loom having an on loom drying system, said water jet loom comprising:

(a) a frame;

(b) a warp forming means;

(c) a shed forming means;

(d) a weft inserting means;

(e) a two mode on loom dryer system downstream from said weft inserting means including: (i) a high volume air supply downstream from said weft inserting means; and (ii) a second dryer adjacent to said high volume air supply, said second dryer being at least one of radiant or convection heating; and (f) a fabric web take-up means.

22. The apparatus according to claim 21, wherein said fabric web take-up includes a frame; a plurality of rollers and a drive means.

23. The apparatus according to claim 21, where in said fabric take up further includes a walk board.

24. The apparatus according to claim 21, wherein said fabric web take-up further includes a fabric compensator.

25. The apparatus according to claim 21, wherein said weft inserting means includes a jet nozzle and a jet pump.

26. The apparatus according to claim 21, wherein said high volume air supply includes a high volume air blower impinging air onto the surface of the web; said second dryer is a radiant heater adjacent to said high volume air supply;

and further including a control system for selectively activating said radiant heater.

27. The apparatus according to claim 26, wherein said high volume air blower is a tangential blower.

28. The apparatus according to claim 26, wherein said high volume air blower produces greater than about 1000 CFM per linear yard.

29. The apparatus according to claim 28, wherein said CFM per linear yard is about 2500 CFM.

30. The apparatus according to claim 26, wherein said high volume air blower produces air perpendicular to the fabric web.

31. The apparatus claimed in claim 26, wherein said radiant heater is a radiant emitter panel.

32. The apparatus according to claim 31, wherein said radiant emitter panel produces about 10 watts per square inch.

33. The apparatus according to claim 26, wherein said radiant heater produces a fabric surface temperature greater than about 100° F.

34. The apparatus according to claim 33, wherein said radiant heater produces a fabric surface temperature of about 120° F.

35. The apparatus according to claim 26, wherein said radiant heater is downstream of said high volume air supply.

36. The apparatus according to claim 26, wherein said radiant heater is opposed to said high volume air supply.

37. The apparatus according to claim 26, wherein said control system includes at least one stop motion detector for determining when to deactivate said radiant heater.

38. The apparatus according to claim 37, further including a heat shield movable between said radiant heater and the fabric surface.

* * * * *